US007293357B2

(12) United States Patent
Holland

(10) Patent No.: US 7,293,357 B2
(45) Date of Patent: Nov. 13, 2007

(54) TOOL OPERABLE FOR ATTACHING A SOLID PIN TO A STRANDED WIRE

(75) Inventor: Michael Holland, 107 Via del Cielo, Santa Barbara, CA (US) 93109

(73) Assignee: Michael Holland, Santa Barbara, CA (US)

( * ) Notice: Subject to any disclaimer, the term of this patent is extended or adjusted under 35 U.S.C. 154(b) by 320 days.

(21) Appl. No.: 11/051,201

(22) Filed: Feb. 3, 2005

(65) Prior Publication Data

US 2005/0181669 A1 Aug. 18, 2005

Related U.S. Application Data

(60) Provisional application No. 60/545,455, filed on Feb. 17, 2004.

(51) Int. Cl.
*H01R 43/00* (2006.01)
*H01R 9/05* (2006.01)

(52) U.S. Cl. ..... 29/857; 29/745; 29/754; 29/755; 29/828; 439/578

(58) Field of Classification Search ..... 29/757, 29/828, 745, 754, 755, 761, 769; 174/89, 174/71 C, 88 C, 75 C; 439/578, 745, 582, 439/583, 584, 827

See application file for complete search history.

(56) References Cited

U.S. PATENT DOCUMENTS 2,896,186 A * 7/1959 Hardmark ..... 439/430
5,267,337 A * 11/1993 Kirma ..... 385/75
6,109,984 A * 8/2000 Tsou ..... 439/888
6,361,364 B1 * 3/2002 Holland et al. ..... 439/578

* cited by examiner

*Primary Examiner*—A. Dexter Tugbang
*Assistant Examiner*—Tai Van Nguyen
(74) *Attorney, Agent, or Firm*—Michael G Petit; Laura N Tunnell

(57) ABSTRACT

The invention describes, in combination, a pin and a pin holding device and discloses a method for electrically and mechanically connecting the stranded center conductor of a microcoaxial cable to the pin without the use of traditional soldering or crimping methods. The invention allows a cable installer to connect an end of a microcoaxial cable having a stranded center conductor to a male coaxial cable connector which requires a solid center conductor such as a pin for greatest reliability. The invention provides a stranded conductor to solid wire adaptor. In a preferred embodiment, the invention utilizes a twist-wirelock section to affix a stranded wire center conductor to a solid pin.

1 Claim, 1 Drawing Sheet

TOOL OPERABLE FOR ATTACHING A SOLID PIN TO A STRANDED WIRE

This application claims the benefit of U.S. Provisional Application Ser. No. 60/545,455, filed Feb. 17, 2004.

BACKGROUND OF THE INVENTION

1. Field of the Invention

The present invention relates to coaxial cable connections, their implementation and use 2. Prior Art In signal transmission applications, the choice of coaxial cable for conducting the signal is usually determined by the distance between connection points, the signal frequency, the maximum bend radius required, and the connector space available in a particular transmitting and/or receiving device. The longer the cable and the higher the frequency used, the larger the outside diameter needs to be to prevent excessive signal loss. Traditional coaxial cable applications such as Cable TV, Broadband data, and microwave signal transmission, employ coaxial cables with O.D.'s of 0.25-1 inches for distances of 50-1000 feet. In indoor equipment, the shorter distance requirements (typically 6-24 inches), the limitations of limited space and tighter bend radius requirements are overcome by using smaller coaxial cables with O.D.'s of 0.1-0.14 inches. These small OD cables typically require the use of precision micro-connectors such as SMA, SMB and MCX, which must be connected to the cable in a more or less controlled setting such as a laboratory with precise equipment to both hold and electrically attach the cable to the connectors. The central conductor for such microcoaxial cables is usually attached to the connector by either soldering directly to a fixed center pin in the connector, or soldering or crimping the central conductor to a separate small center pin which is then inserted into the connector. The soldering method requires both electricity and a clean, well lighted area for assembly. The use of small separate center pins, with a diameter of about 0.040 inch, need careful handing and holding during assembly. The installer needs to hold the pin, place it over the cable center conductor, and then perform the solder or crimp procedure.

With the increased demands on broadband network centers and field located hubs, there exists a need for higher density coaxial cable bundles having as many as 200 coaxial cables connected between equipment locations 100 feet apart. These new high-density cable assemblies now require field-installable connectors that are installed in lab environments. The high-density equipment backplanes also require microcoaxial cable connectors rather than larger connectors used when only a few low density cables are involved. The new cable requirements have been met with the development of lower loss microcoaxial cable bundles containing as many as 12 coaxial cables (each with a 0.1 in. OD) within in a 0.45 inch diameter jacket. There is a need for a reliable method of attaching these microcoaxial cable connectors to the microcoaxial cables in the field without the need for soldering and special handling equipment. A problem encountered during field installation of microcoaxial cable connectors is chemical contamination of conductive parts of the assembly from the installer's hands. Precision microcoaxial cable connectors are usually plated with gold to limit oxidation and thus require a level of cleanliness to insure proper performance. It is very difficult to insure this level of clean handling when the installer is required to manually grasp the connection center pin in the microcoaxial connector during installation.

Coaxial cables with larger center conductors of over 0.031 in. (0.8 mm) usually use the central conductor as the male center pin within the (assembled) male connector. The central conductor is then inserted directly into the female receptacle that comprises a mating seizing pin. Smaller cables require a male pin to first be attached to the (smaller) central conductor in order to confer the rigidity to the male pin needed to overcome the insertion force required for mating engagement with the female receptacle. Even with additional fixed center pins, the insertion force required for secure engagement can still be limited by the weaker section of the small central conductor not supported by the larger fixed pin.

Coaxial cable connector construction and installation is well known in the established art. The present inventor, in copending U.S. Pat. No. 6,217,383 discloses a compression-type coaxial cable connector. The connector, and each of the components associated therewith, has an axial conduit coextensive with the length thereof. When the prepared end of a coaxial cable is advanced through the conduit into the body portion, a shank separates the outer protective jacket and conductive braid of the cable from the dielectric core and interposes the barbed portion of the tubular shank therebetween. A compression sleeve, with the assistance of a compression tool, compresses the cable jacket and braid providing secure attachment.

Stirling, in U.S. Pat. No. 5,007,861, discloses a crimpless coaxial cable connector which can be secured to a cable simply by pushing the cable into the connector and subsequently pulling it back. The body of the connector has a bushing mounted within it near the cable-receiving end having a conduit dimensioned to receive the cable. The body of the connector also has within it an annular mandrel having a bore to receive the stripped core of the cable, and having a sleeve adapted to engage the cable beneath the jacket by pushing the cable and the mandrel together.

Another radial compression type of coaxial cable connector of the type generally used today for forming an electrical connection between a central conductor within the coaxial cable and a mating fixture is described in detail in U.S. Pat. No. 5,632,651 to Szegda. Various other coaxial cable connectors adapted to from a secure, electrically conductive connection between a coaxial cable and a threaded female port have been developed. Such prior art connectors are discussed, for example, in U.S. Pat. No. 5,024,606 to Ming-Hua, U.S. Pat. No. 4,280,749 to Hemmer, U.S. Pat. No. 4,593,964 to Forney, Jr. et al., U.S. Pat. No. 5,073,129 to Szegda and U.S. Pat. No. 5,651,699 to Holliday. U.S. Pat. No. 5,879,191 to Burris, discusses prior art efforts to provide a coaxial connector which is moisture-proof and minimizes radiative loss of signal from the cable.

All of the above-referenced connectors require that a stripped length of the coaxial cable' central conductor project from the end of the cable within the axial bore in the connector for engagement with a conductive receptacle in the mating fixture. The prior art connectors work well with standard coaxial cables having a relatively large gauge central conductor because the stripped length is rigid. The rigid conductor can be forced into a spring receptacle in a mating fixture without difficulty. Microcoaxial cables, however, have a small, fragile central conductor. The stripped length of the central conductor in a microcoaxial cable lacks the structural integrity for insertion into a conductive receptacle in a mating fixture. It is current practice to solder or crimp an electrically conductive cap over the stripped length of central conductor in order to provide sufficient rigidity to the central conductor for use with standard connector assemblies.

The present inventor, in U.S. Pat. No. 6,361,364, discloses a method of electrically and mechanically connecting the center conductor of a micro-coaxial RF cable to a coaxial cable connector or bulkhead without the use of traditional soldering or precision tools. The device is essentially a solderless, crimpless connector. The invention allows a cable installer to connect a micro-coaxial cable having a central conductor as small #30 AWG (0.25 mm) to a coaxial cable connector under field conditions. The invention employs a two-stage, spring loaded center pin holding device and a method for using the device to facilitate easy field installation while maintaining mechanical and electrical reliability.

It has become popular to use a stranded center conductor for coaxial microcables to add greater flexibility and prevention of the solid micro center conductor from breaking due to bending. An equivalent #26 stranded wire might consist of 5 #36 conductors which creates an even greater need for a solid pin adaptor for insertion into the connector.

The prior art consists of four methods of attaching a stranded center conductor of a coaxial cable to a coaxial connector. The first is crimping or soldering an external pin attached to a crimp or solder cap. This method has been used for larger conductors, typically #16-20 gauge wire. This, as mentioned earlier, is not effective for coaxial microcables in that the soldering may melt the other plastic components of the cable and is difficult to perform except in laboratory conditions. Crimping requires the precision of a magnified view and special tools. The crimp cap must also be able to compress to an effective range to hold the microstranded wires. This is easy with larger wires where the larger caps' wall thickness can provide the needed strength upon compression The second prior art method is to blindly insert the stranded wire into the entire connector assembly trying to guide the flexible wire into an open hole of cylindrical seizing pin. Upon compressing or crimping of the entire connector assembly, a sliding tapered outer cylindrical member squeezes the seizing pin down on the stranded wire. The problem with this method is that the flexible stranded wire center conductor of a microcable (smaller than #22 gauge) does not have the structural ability to move into the connector any distance without bending and bunching up; resulting in the conductor never entering the connector's center conductor seizing pin. The ability to insure a tight mechanical and electrical connection to the stranded micro center conductor prior to insertion into the connector assembly is needed for high reliability performance.

The third prior art method consists of a variation of the prior method, having an internal cylindrical open seizing clamp inside the connector body. The stranded center coaxial cable is inserted into the open cylindrical seizing pin which then is intended to be pushed inward through a tapered hole until the taper compresses the seizing pin to hold the stranded wire securely. To accomplish this inward movement of the seizing pin through the tapered hole, the cable is used as the axial force tool by pushing inward. The problem with this method is that it can only work effectively if the cable is rigid and will not bend upon the axial force needed to drive the clamp tube through the taper. This method has worked with coaxial cables having a minimum outside diameter of 6.5 mm and typically 12 mm. In that the micro coaxial cables intended for this invention may have an O.D. ranging from 2-5 mm, and limited axial force capability, the mentioned prior art will not work. A second reason for this methods' failure is that the inward moving pin/clamp tube must lock into a notch to prevent later retraction of the cable and center pin from loosening around the stranded center wire. The user cannot always be sure they have engaged this locking notch due to the difficulty of knowing how far to insert the cable. One additional reason for this external stranded-to-solid pin adaptor is to give the user the ability to insure the stranded conductors are secure in the new fixed pin.

The forth prior art method consists of inserting the stranded wire into a flat seizing pin which allows the wire to push open the contact and be held based upon the spring retention of the spring clamping pins. This method relies upon the rigidity of the stranded wire to open up the clamp without bending.

Due to the fragile nature of stranded conductors, the above-referenced devices and methods are not suitable for connecting the stranded center conductor of a coaxial microcable to a coaxial cable connector. Crimp methods of securing an adaptor pin used in solid wire cables will only work with larger solid cables and will not work well for a micro stranded wire due to the difficulty in using a tool in non-laboratory conditions. A method and device is needed to attach a larger diameter pin (typically 1 mm o.d.) over a stranded wire having an outer diameter of 0.45 mm. Accordingly, there is a current need for a solderless device and method for adapting the stranded central conductor of a microcoaxial cable for use with standard coaxial cable connectors without the need for soldering or precision crimping.

SUMMARY

It is an object of the present invention to provide a method and device for installing a hollow, unitary pin over an exposed (stripped) length of a stranded center conductor of a microcoaxial cable wherein the center conductor comprises a plurality of stranded, fragile wires.

The above objective is met by the provision of a tool operable for attaching a solid pin having a hollow recess on a trailing end thereof to the stripped end of a stranded center conductor of a microcoaxial cable. The tool comprises a pin holder and a pin releasably housed within an axial bore in the pin holder. The pin holder comprises an elastically deformable, preferably elongate member dimensioned to be grasped between the fingers. The elastically deformable member has an axial bore extending inwardly from a trailing end thereof. The pin has a solid leading end and a trailing end having a substantially conical recess therein with threads thereon. The pin is releasably housed within the axial bore of the pin holder with the trailing end of the pin oriented toward the trailing end of the axial bore. The pin holder preferably has a longitudinal slot therein extending forwardly from said trailing end of the pin holder and inwardly from an outer surface of the pin holder to the axial bore so that manual pressure on the outer surface of the pin holder increases the holding force on the pin housed in the axial bore to prevent the pin from turning.

In operation, the method for attaching the solid, electrically conductive pin to the stranded central conductor of a microcoaxial cable comprises the steps of: (a) presenting a tool as described above; then (b) inserting a stripped length of the stranded central conductor of the microcoaxial cable into the hollow recess in the trailing end of the pin; then (c) advancing the microcoaxial cable toward the pin while twisting the cable; then (d) withdrawing the microcoaxial cable away from the pin holder to extract the pin attached thereto from the axial bore of the pin holder.

The features of the invention believed to be novel are set forth with particularity in the appended claims. However the invention itself, both as to organization and method of operation, together with further objects and advantages thereof may be best understood by reference to the following description taken in conjunction with the accompanying drawings.

DESCRIPTION OF THE PREFERRED EMBODIMENTS

Figure 2:
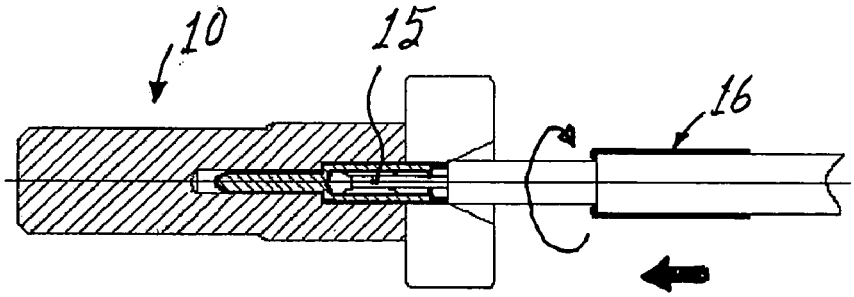
FIG. 2 shows the insertion of the stranded central conductor into a threaded recess within the pin releasably housed within the device of FIG. 1 and the device and microcable rotated with respect to one another to affix the pin to the stranded central conductor.
Figure 3:
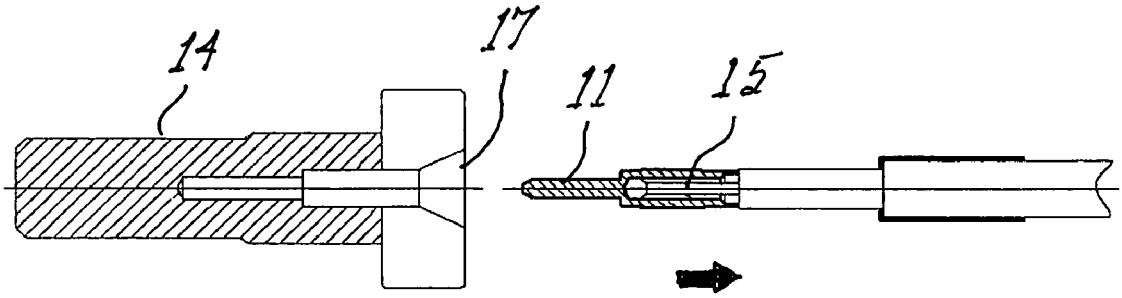
FIG. 3 shows the pin securely affixed to the stranded central conductor when the cable is retracted from the device.

With reference to FIGS. 1-4, the first embodiment of the pin installing device of the present invention, indicated at numeral 10, comprises a solid pin 11 having a hollow trailing end 12 housed within an axial bore 13 of a pin-holding device 14. The hollow trailing end 12 of the pin 11 has a conically tapered, spiral-threaded interior wall. The stranded center conductor 15 of a microcoaxial cable 16 is inserted into the cone-shaped hollow trailing end 12 of the pin 11, as shown in FIG. 2, and advanced into the hollow trailing end of the pin in the direction of the broad arrow while twisting (FIG. 2) until the stranded conductors 15 are forced into engagement with the threads creating a lock between the stranded central conductor and the hollow trailing end of the pin. The cable 16 is then retracted as shown in FIG. 3 with the pin 11 affixed to the central conductor. This pin attachment mechanism is similar to the method used with common electrical wire nuts to splice the conductors of two or more wires. The new, larger solid center pin 11 can be inserted into a coaxial connector having a female seizing pin to receive it or, the new pin may become the center pin of the coaxial connector.

Prior to installation of the pin on the stranded center conductor of the cable, the pin 11, including the hollow trailing end 12 thereof, is mounted in a plastic housing 14 which both allows a leveraged rotation of the pin with respect to the cable for locking. The pin-holding device 14 further includes a cone-shaped guide hole 17 which has an inner diameter that is larger than the outer diameter of the hollow trailing end 12 of the pin 11. This allows a user with poor eyesight or working under poor lighting conditions to insert an exposed length of stranded center conductor 15 on the end of a microcoaxial cable 16 into the twist-locking conical hole 12 in the trailing end of the pin 11 with ease. After rotation, as shown in FIG. 3, the plastic pin housing 14 is slid off of the pin and discarded. The larger, solid center pin 11 can then be inserted into a standard coaxial connector as either the connector's fixed center conductor or it may be inserted into an internal seizing pin within the coaxial cable connector (not shown).

Figure 4:
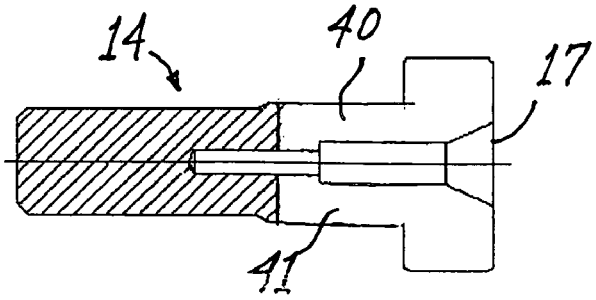
FIG. 4 is a cross-sectional view of a second, most preferred embodiment of the device in accordance with the present invention
Figure 1:
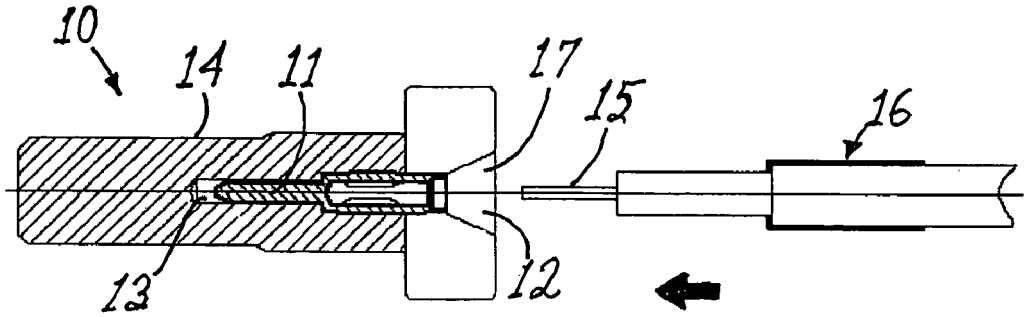
FIG. 1 is a cross-sectional view of a first embodiment of the device in accordance with the present invention wherein the stripped, stranded, central conductor of a microcoaxial cable is poised to be inserted into a pin-holding device prior to twisting the assembly in order to affix the pin that is releasably housed within the pin-holding device to the stranded central conductor of the microcoaxial cable.

In a particularly preferred embodiment of the pin installation device 10 in accordance with the present invention, the pin-holding device 14 has at least one, and more preferably two, longitudinal slots 40 and 41 in the pin-holding end thereof as illustrated in FIG. 4. The slots 40, 41 enable the installer to manually compress the inner wall of the pin-holding device 14 against the pin 11 to prevent the pin 11 from turning as the microcable is advanced and twisted to form a locking engagement between the pin and the stranded central conductor. The present invention contemplates other means, such as, for example, a thumb-actuated plunger, operable for preventing the pin, which is releasably housed within the axial bore of the pin holder, from turning when a twisting force is applied thereto.

While particular embodiments of the present invention have been illustrated and described, it would be obvious to those skilled in the art that various other changes and modifications can be made without departing from the spirit and scope of the invention. For example, the pin holder portion of the tool can be a member having an axial bore, wherein the pin holder has resistance means thereon operable for preventing a pin housed within the axial bore from turning when twisted. It is therefore intended to cover in the appended claims all such changes and modifications that are within the scope of this invention.

What I claim is:

1. A tool operable for attaching a solid pin having a hollow recess on a trailing end thereof to the stripped end of a stranded center conductor of a microcoaxial cable wherein said center conductor comprises a plurality of conductive strands, said tool comprising:

(a) a pin holder comprising an elastically deformable member dimensioned to be grasped between the fingers, said elastically deformable member having an axial bore in a trailing end thereof; and (b) a pin having a solid leading end and a trailing end, said trailing end having a substantially conical recess therein with threads thereon, said pin being releasably housed within said axial bore;

wherein said pin holder has a longitudinal slot therein extending forwardly from said trailing end of said pin holder and inwardly from an outer surface of said pin holder to said axial bore.

* * * * *